US008456315B2

(12) United States Patent
Kriz et al.

(10) Patent No.: US 8,456,315 B2
(45) Date of Patent: Jun. 4, 2013

(54) MONITORING DEVICE FOR FUNCTIONALLY MONITORING REPORTING SYSTEM, REPORTING SYSTEM, AND METHOD FOR MONITORING

(75) Inventors: Stefan Kriz, Munich (DE); Ingo Knopp, Riemerling (DE); Marcus Preisinger, Augsburg (DE)

(73) Assignee: Robert Bosch GmbH, Stuttgart (DE)

( * ) Notice: Subject to any disclaimer, the term of this patent is extended or adjusted under 35 U.S.C. 154(b) by 329 days.

(21) Appl. No.: 12/989,557

(22) PCT Filed: Nov. 24, 2008

(86) PCT No.: PCT/EP2008/066085

§ 371 (c)(1),
(2), (4) Date: Nov. 15, 2010

(87) PCT Pub. No.: WO2009/132717

PCT Pub. Date: Nov. 5, 2009

(65) Prior Publication Data

US 2011/0050440 A1 Mar. 3, 2011

(30) Foreign Application Priority Data

Apr. 28, 2008 (DE) ..... 10 2008 001 428

(51) Int. Cl.
*G08B 21/00* (2006.01)

(52) U.S. Cl.
USPC ..... 340/660; 340/691.6; 340/538

(58) Field of Classification Search
USPC ..... 340/660–665, 679–680, 686.1, 691.3, 340/691.6, 693.1, 687, 511, 514, 512, 538
See application file for complete search history.

(56) References Cited

U.S. PATENT DOCUMENTS

| | | | | |
|---|---|---|---|---|
| 3,646,552 | A | 2/1972 | Fuhr | |
| 4,918,432 | A * | 4/1990 | Pauley et al. | 340/573.4 |
| 5,406,071 | A * | 4/1995 | Elms | 250/214 A |
| 5,548,277 | A * | 8/1996 | Wild | 340/578 |
| 5,745,308 | A * | 4/1998 | Spangenberg | 359/818 |
| 5,875,312 | A * | 2/1999 | Walsh et al. | 710/303 |
| 6,101,610 | A * | 8/2000 | Beebe et al. | 713/323 |
| 7,250,848 | B2 * | 7/2007 | White, II | 340/12.32 |

FOREIGN PATENT DOCUMENTS

| | | |
|---|---|---|
| DE | 26 32 738 | 1/1978 |
| DE | 10 2005 060 123 | 6/2006 |
| DE | 10 2005 038 602 | 2/2007 |
| DE | 10 2007 008 263 | 8/2008 |
| GB | 2 286 735 | * 2/1994 |
| GB | 2 286 735 | 8/1995 |
| GB | 2 429 317 | 2/2007 |
| GB | 2 447 122 | 9/2008 |

* cited by examiner

*Primary Examiner* — Daniel Previl
(74) *Attorney, Agent, or Firm* — Michael J. Striker

(57) ABSTRACT

A monitoring device (6,10) monitors the functioning of a reporting system (1). The reporting system (1) includes a plurality of reporting devices (4) and/or signaling devices, supply lines (3), and a voltage source. The reporting devices (4) and/or signaling devices are connected to the voltage source via the supply lines (3), and the reporting devices (4) and/or signaling devices are connected in parallel to one another and to the voltage source. A test signal device (6) connects a reference resistor (R) into the supply lines (3) in parallel with the reporting devices (4) and/or signaling devices, and/or connects the reference resistor (R) as a termination of the supply lines (3). An evaluation device (10) detects and evaluates the system response of the reporting system (1) to the connecting of the reference resistor (R).

12 Claims, 2 Drawing Sheets

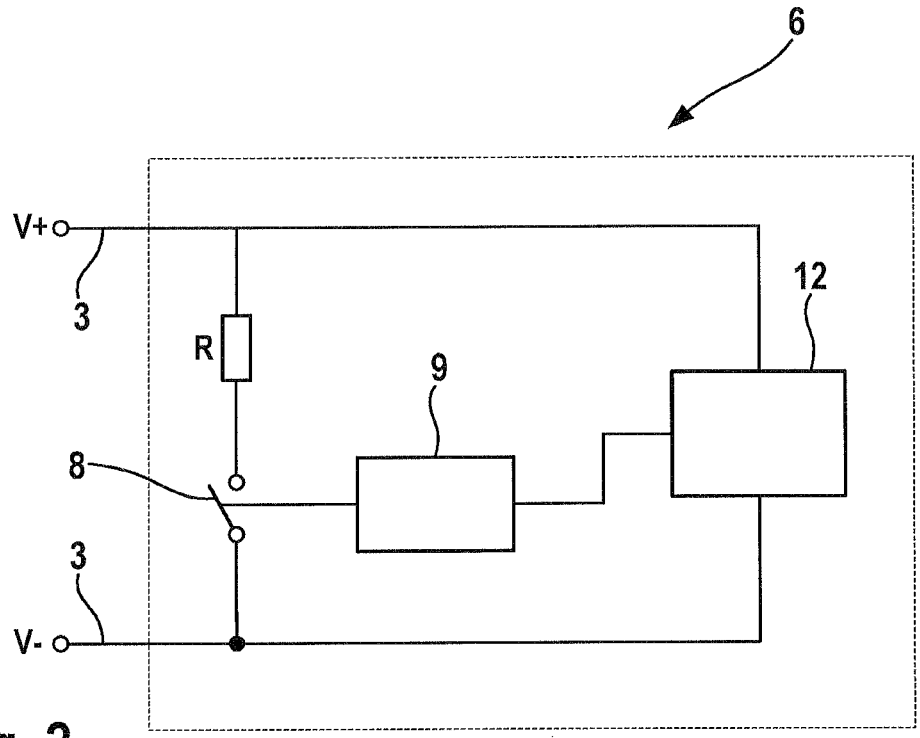
Fig. 2
Fig. 3
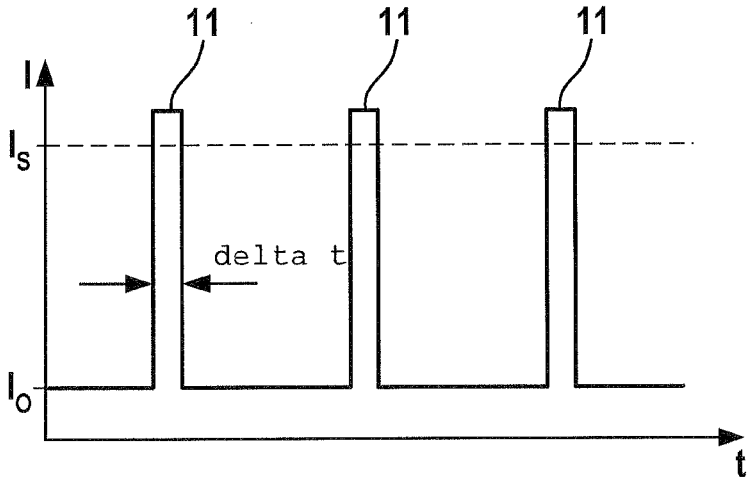

MONITORING DEVICE FOR FUNCTIONALLY MONITORING REPORTING SYSTEM, REPORTING SYSTEM, AND METHOD FOR MONITORING

CROSS-REFERENCE

The invention described and claimed hereinbelow is also described in PCT/EP2008/066085, filed on Nov. 24, 2008 and DE 10 2008 001 428.1, filed Apr. 28, 2008. This German Patent Application, whose subject matter is incorporated here by reference, provides the basis for a claim of priority of invention under 35 U.S.C. 119 (a)-(d).

BACKGROUND INFORMATION

The invention relates to a monitoring device for monitoring the function of a reporting system, the reporting system comprising a plurality of reporting devices and/or signalling devices, supply lines, and a voltage source, wherein the reporting devices and/or signalling devices are connected to the voltage source via the supply lines, and the reporting devices and/or signalling devices are connected in parallel to one another and to the voltage source. The invention furthermore relates to a reporting system comprising this monitoring device, and a method for checking the operating capability of a or the reporting system.

Reporting systems, such as fire alarm systems, alarm systems, or the like, are used as communication devices usually in large plants, wherein reports are generated automatically or manually at decentralized locations, and are forwarded to a control center. To this end, the reporting systems comprise a plurality of reporting devices which are connected to each other and the control center via signal lines and/or supply lines. According to a widespread embodiment, the supply lines and signal lines are combined to form a two-wire line, wherein the change in current flow or voltage is monitored in the two-wire line and, if changes are detected, a report is generated in the control center.

Publication DE 10 2005 038 602 A1, which is the closest prior art, describes, in the introduction, a safety device of that type that uses d.c. line technology, wherein the safety device includes primary lines in the form of circuits supplied with direct voltage, at the end of which, i.e. at the point to be monitored, a terminal resistor is disposed. The terminal resistor and the current flow through this terminal resistor are monitored by an evaluation circuit in the control center. If the resistance value of the terminal resistor changes e.g. by more than plus/minus 40%, this is interpreted as external intervention, and an alarm is triggered.

SUMMARY OF THE INVENTION

What is disclosed is a monitoring device for monitoring the function of a reporting system having the features of claim 1, a reporting system having the features of claim 5, and a method for checking the operating capability of a or the reporting system having the features of claim 11. Preferred or advantageous embodiments of the invention result from the dependent claims, the description that follows, and the attached figures.

A monitoring device that is suitable and/or designed to monitor the function, in particular the state, of a reporting system is provided within the scope of the invention. In particular, the monitoring device is designed to detect a creeping line interruption. The reporting system comprises a plurality of reporting devices and/or signalling devices, supply lines, and a voltage source. The reporting devices and signalling devices are connected to the voltage source via the supply lines, and therefore the reporting devices and signalling devices are electrically connected in parallel to one another and to the voltage source. The reporting devices can be designed as manual reporting devices, e.g. manual fire alarms to be activated or the like, emergency call reporting devices, or as automatic reporting devices such as motion detectors, heat detectors, fire alarms, etc. The signalling devices can be realized as optical, acoustic, and/or haptic signalling devices such as signalling horns or warning lights. The supply lines are preferably acted upon by the voltage source with a direct voltage, and therefore the type of supply line can be referred to as a two-wire line and/or the design can be referred to as d.c. line technology.

The reporting devices are preferably designed such that, when a report is activated, the reporting devices switch from an open line state to a closed line state, and a reporting resistor is connected into the line.

The monitoring device includes a test signal device which is designed to connect a reference resistor into the supply lines in parallel to the reporting devices, and/or which is designed to connect a or the reference resistor as the termination of the supply lines. The monitoring device also includes an evaluation device for detecting and evaluating the system response of the reporting system to the connecting of the reference resistor. According to a first alternative, the reference resistor is connected to the reporting devices and, optionally and in addition thereto, to a terminal resistor. In the second alternative, the reference resistor is temporarily activated as a terminal resistor. The terminal resistor is preferably the resistor that is situated furthest away and/or after the largest number of upstream reporting devices when reporting devices and the terminal resistor are connected in parallel.

In the case of typical reporting systems, a terminal resistor is connected at the end of the supply lines, thereby ensuring that the voltage source constantly applies a voltage to the terminal resistor. This circuit requires that a constant quiescent current flow through the terminal resistor, which can be monitored in a control center. If a line interruption occurs, the quiescent current stops flowing, which can be detected in the control center as a disturbance. A complete line interruption is problematic, as are "creeping line interruptions" which are caused e.g. by an incomplete cable break or a slow increase in the contact resistance of plug-in contacts or screw-type contacts. In the worst case, these creeping line interruptions can result in the failure of the reporting devices and, therefore, the reporting system. The reason for this is that the creeping line interruptions correspond to a resistor being connected in series in the supply lines; in the worst case, due to the voltage drop at this resistor, the operating voltage at the reporting devices can fall short. If the reporting devices are not operable, events cannot be detected.

Creeping line interruptions also cause the quiescent current through the above-described terminal resistor to diminish, which can be detected by the control center and displayed as a disturbance. This type of detection is problematic, however, due to the situation in which a reporting resistor is connected into the supply lines in parallel when one or more of the reporting devices attempts to issue a report. The voltage divider between the line resistance of the creeping line interruption and the reporting resistor of the reporting device therefore changes, thereby reducing the power supply voltage at the reporting device. If the undetected line resistance of the creeping line interruption is too high, the permissible operating voltage of the reporting device will fall short when the reporting device switches to the reporting state. Moreover, it is possible that the current required by the alarm for detection and to trigger the alarm will stop flowing. In borderline cases, this chain of errors is difficult to detect and monitor by monitoring the quiescent current.

Finally, it was recognized that, in the previous method of monitoring for creeping line interruptions using a simple terminal resistor, the idle state of the reporting system was continually evaluated, but not the relevant reporting case itself.

By way of the test signal device, an active end-of-line circuit and/or an intermediate circuit is installed instead of and/or in addition to a simple terminal resistor. The advantage of this design is that the test signal device can briefly simulate a relevant reporting case. The reaction to the connecting of the reference resistor of the reporting system, which manifests as increased current, can be detected and evaluated by the evaluation device. An increase in the creeping line resistance results in a reduction of the quiescent current and the increased current. A creeping line interruption can be inferred by comparing the current, when a reference resistor is connected, to a specified value and/or to the quiescent current.

According to a particularly preferred embodiment of the invention, the test signal device is designed to connect the reference resistor in a temporary and/or pulsed manner. The pulse duration is preferably short enough to not be interpreted as a real report by the reporting device. For example, the pulse duration that occurs while the reference resistor is connected is less than 0.5 seconds, and preferably less than 0.25 seconds. The duration of the connecting pulse is preferably equidistant, and can be selected such that the reference resistance is connected in time intervals of longer than one second, preferably longer than 5 seconds, and in particular longer than 10 seconds. Connecting the reference resistor on a regular basis has the advantage that, if the system does not respond, then a complete line interruption can be inferred.

According to a preferred development of the invention, the evaluation device includes means for distinguishing between the system response that is generated when the reference resistor is connected, and when a reporting device is triggered. These means can observe e.g. the duration of the system response, evaluate the time interval of the system response, or be designed as a filter.

According to a development of the invention, the test signal device is designed to measure the voltage in the supply lines. The test signal device is preferably implemented using programming or circuitry, thereby ensuring that the reference resistor is switched off and/or deactivated when a specified or specifiable voltage value is fallen below. This development is based on the consideration that connecting the reference resistor in the test signal device can also result in the permissible reporting system operating voltage falling short, e.g. if line damage occurs or if reports from other reporting devices are already present.

If the default voltage value is fallen below, the reference resistor is disconnected, thereby deactivating the generation of further system responses, in particular further current pulses. Due to the deactivation, the evaluation device does not receive a system response from the reporting system that can be traced back to the connecting of the reference resistor, and the reporting system can interpret this as a disturbance or a reporting case.

The invention also relates to a reporting system having the features of claim 5, and which includes a plurality of reporting devices, supply lines, and a voltage source, wherein the reporting devices are connected to the voltage source via supply lines, and the reporting devices are connected in parallel to one another and to the voltage source. The reporting system is characterized in that a monitoring device according to one of the preceding claims, or as described above, is integrated.

According to a particularly preferred embodiment, the reporting devices are designed as manual and/or automatic reporting devices that connect a reporting resistor when activated. Particularly preferably, the value of the reference resistor is equal to or substantially equal to the value of the reporting resistor. By making this selection, the reporting case can be simulated by the test signal device in a particularly realistic manner. As an alternative, the reference resistance can be selected to be less than the reporting resistance. According to a further preferred embodiment, the value of the reference resistor of the common resistor corresponds to all or a few, e.g. two or three, reporting resistors connected in parallel. This embodiment takes into account the fact that, when a report is issued, more than one reporting resistor R1, R2 . . . could be activated, thereby resulting in the connected total resistance Rgesamt in the line according to the formula 1/Rgesamt=(1/R1)+(1/R2) . . . , and the fact that the reference resistance is adapted to this total resistance, which is lower than the reporting resistance.

According to one possible structural embodiment, the test signal device is designed as a separate assembly which is enclosed in a housing, for instance. According to another structural embodiment, the test signal device is integrated in a reporting device, and/or is coupled in a signalling manner therewith such that the reporting resistor of the reporting device is connected as the reference resistor.

According to a supplemental or alternative structural embodiment, the voltage source and the test signal device are both integrated in a reporting center. This embodiment makes it possible for the reporting system to be integrated in a housing or the like with few components. The reporting center can also contact a plurality of branches of supply lines, each branch being designed as a two-wire line and preferably being evaluated separately from each other. The test signal device and the evaluation device can be designed using a rigid circuit and/or it can be analog in design. According to another embodiment, one or both devices include a data processing device, in particular a microcontroller, wherein parameters of the monitoring device such as the pulse duration of the connection, or limit values for current or voltage, can be easily input.

A final subject matter of the invention relates to a method for checking the operating capability of a reporting system having the features of claim 11, wherein the reporting system is preferably designed according to one of the preceding claims, and a reference resistor, as a terminating resistor and/or in parallel with a terminating resistor, is connected temporarily and/or in a pulsed manner, wherein the current flow is measured in the region of the voltage source, and the operating capability of the reporting system is determined by comparing the current flow value, with the reference resistor connected, to a specified limit value.

The current is preferably measured using a measurement shunt. According to a preferred embodiment, the duration of the connection of the reference resistor is shorter than the signal duration of a triggered reporting device.

BRIEF DESCRIPTION OF THE DRAWINGS

Further features, advantages, and effects of the invention result from the following description of a preferred embodiment of the invention. The drawings show:

FIG. 2 a detailed sectional view of the block diagram depicted in FIG. 1, in the region of a test signal device;

FIG. 3 a schematic graph to illustrate the mode of operation of the embodiment.

DETAILED DESCRIPTION OF THE PREFERRED EMBODIMENT(S)

Figure 1:
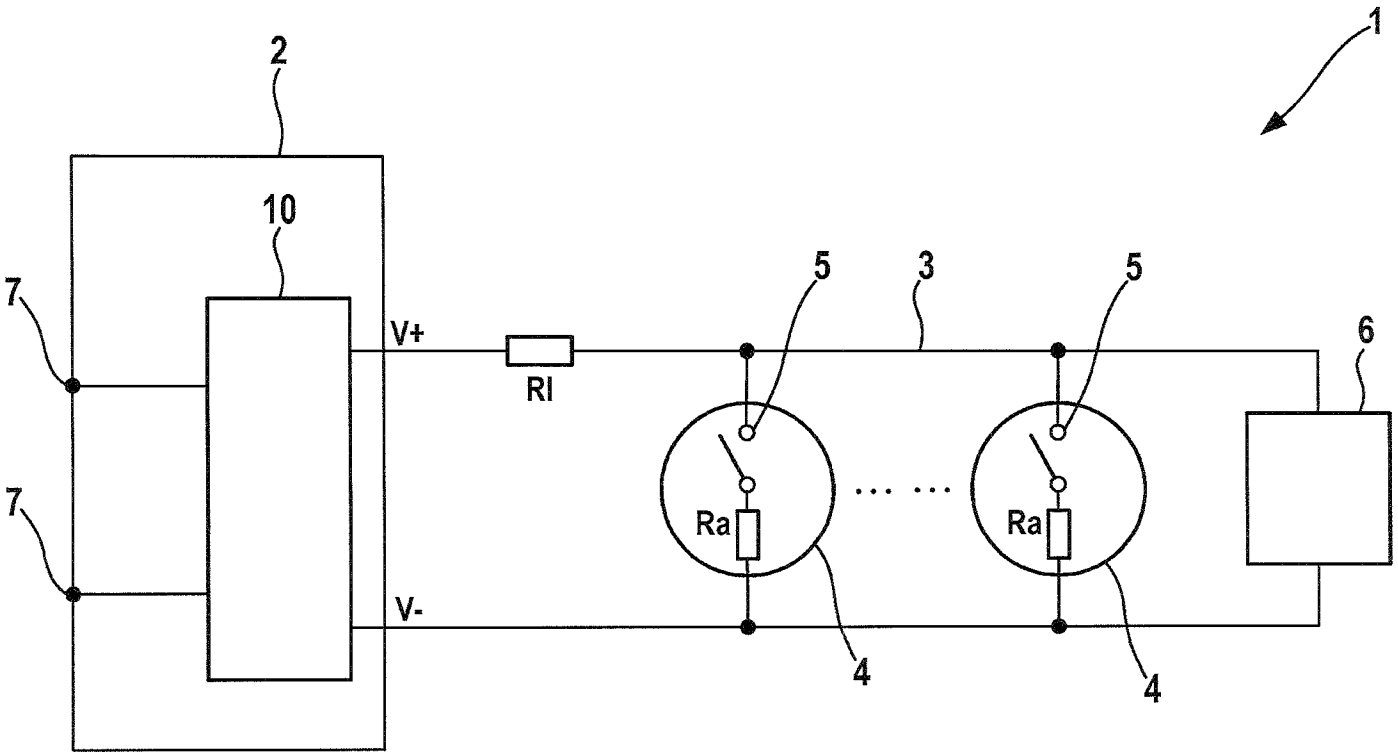
FIG. 1 a schematic block diagram of a first embodiment of the invention.

FIG. 1 shows a schematic block diagram of a reporting system 1 as an embodiment of the invention, which is designed e.g. as a fire alarm system or an alarm system.

Reporting system 1 includes a control center 2 in which a direct-voltage source (not shown) is disposed. A plurality of reporting devices 4 is connected via supply lines 3 to control center 2 and to the direct-voltage source, the reporting devices 4 being connected in parallel. Supply lines 3 are preferably designed as a two-wire line, the two-wire line ensuring that power is supplied and signals are transmitted. Reporting devices 4 can be designed e.g. as manual reporting devices, fire alarms, automatic reporting devices, motion detectors, etc. When one of the reporting devices 4 is activated, a switch 5 or an equivalent component is closed, thereby connecting a reporting resistor Ra between supply lines 3. Reference numeral 6 labels a signal testing device that is disposed in the circuit opposite control center 2, at the end of supply lines 3, as the terminal. Other reporting systems 1 include a terminal resistor instead of test signal device 6. According to the mode of operation of reporting system 1, when a report is issued, one or more of the reporting devices 4 closes switch 5, thereby connecting reporting resistor Ra. The connection generates or increases current flow through supply lines 3, which is detected by suitable means in control center 2 and is interpreted as a report. A report can be transmitted via one or more interfaces 7.

During operation, "creeping line interruptions" can occur, which are caused by incomplete cable breaks or slow increases in contact resistances. A creeping line interruption of this type is depicted in the block diagram using resistance Ri which is connected in series in supply lines 3.

To detect the operating capability of reporting system 1 and, in particular, to detect creeping line interruptions such as resistance Ri, test signal device 6 is designed to connect a reference resistor R in supply lines 3 in parallel with reporting devices 4, preferably at regular time intervals.

FIG. 2 shows test signal device 6 in a somewhat detailed representation, in which it is shown that reference resistor R can be connected to supply lines 3 in parallel via a switching device 8. Switching device 8 is connected or activated e.g. by a pulse generator 9. Test signal device 6 only connects a passive element into supply lines 3 with reference resistor R.

FIG. 3 shows a graph, over time, of current I in supply lines 3 through an evaluation device 10 which is integrated in control center 2 or is designed as a separate component, current I being graphed over time t. When reference resistor R is not connected, a current I0 flows; if all reporting devices 4 are open, current I0 is zero or corresponds to a quiescent current value. When reference resistor R is temporarily connected, current peaks 11 occur, each current peak 11 representing a connection of reference resistor R. The pulse duration, delta t, of the pulse peaks approximately corresponds to the duration of the connection of reference resistor R, and is approximately 250 ms. A check is carried out in evaluation device 10 to determine whether the amplitude and/or the absolute value of pulse peaks 11 exceeds a reference value. If so, the presence of a sufficiently low resistance Ri, as a creeping line interruption, is inferred. If the amplitude and/or absolute value of pulse peaks 11 are below this specified or specifiable value, the presence of a creeping line interruption or another malfunction is assumed, and an interference signal is transmitted to interfaces 7. Pulse duration delta t is selected such that evaluation device 10 can clearly distinguish the system response from an activation of a reporting device 4 when a report is issued.

Reference resistance R is preferably equal or nearly equal to one of the reporting resistances Ra, so that an alarm is simulated when reference resistor R is connected. If, when an alarm is issued, the voltage would fall below a permissible or necessary operating voltage for the reporting system due to increased line resistance Ri, then, in the simulated alarm case, when reference resistor R is connected, a previously calculated minimum value of current pulse IS is fallen below, thereby ensuring that a creeping line interruption can be detected in a timely manner via evaluation of the current pulses, and can be displayed as a disruption.

Optionally, in addition thereto, test signal device 6 includes a voltage monitor 12 which is designed and/or connected to monitor the voltage applied to supply lines 3. Voltage monitor 12 is disposed at the end of supply lines 3 opposite the voltage source. Voltage monitor 12 ensures that, when reference resistor R is connected, a permissible operating voltage for a reporting device is fallen below e.g. as in the alarm case described above. If a default minimum voltage is fallen below, the reaction thereto is for the periodic connection of switching device 8 or reference resistor R to be deactivated, thereby halting the generation of current pulses. The absence of characteristic current pulses 11 enables evaluation device 10 to detect a line interruption or a falling below of the default minimum voltage, and to output this result as a report to interfaces 7.

Test signal device 6 is designed as an end-of-line circuit and can be used e.g. in conventional fire alarm systems to meet the expanded requirements of the standards DIN EN 54-2 and DIN EN 54-13.

What is claimed is:

1. A monitoring device (6,10) for monitoring the function of a reporting system (1), the reporting system (1) comprising:

a plurality of reporting devices (4) and/or signalling devices, supply lines (3), and a voltage source, wherein the reporting devices (4) and/or signalling devices are connected to the voltage source via the supply lines (3), and the reporting devices (4) and/or signalling devices are connected in parallel to one another and to the voltage source, characterized by a test signal device (6) which is designed to connect a reference resistor (R) into the supply lines (3) in parallel with the reporting devices (4) and/or signalling devices, and/or which is designed to connect a or the reference resistor (R) as a termination of the supply lines (3), and comprising an evaluation device (10) for detecting and evaluating the system response of the reporting system (1) to the connecting of the reference resistor (R), wherein the monitoring device is configured such that connection of the reference resistor (R) simulates a reporting situation.

2. The monitoring device (6, 10) according to claim 1, wherein the test signal device (6) is designed to connect the reference resistor (R) in a pulsed manner.

3. The monitoring device (6, 10) according to claim 1, wherein the evaluation device (10) includes means for distinguishing between the system response that occurs when the reference resistor (R) is connected, and the triggering of a reporting device (4).

4. The monitoring device (6,10) according to claim 1, wherein the test signal device (6) is designed to measure the voltage in the supply lines (3), and is designed, via programming or circuitry, to shut off and/or deactivate the reference resistor (R) if the voltage drops below a certain value.

5. A reporting system (1) comprising a plurality of reporting devices (4) and/or signalling devices, supply lines (3), and a voltage source, the reporting devices (4) and signalling devices being connected to the voltage source via supply lines (3), and wherein the reporting devices (4) and signalling devices are connected in parallel to one another and to the voltage source, further comprising a monitoring device (6,10) according to claim 1.

6. The reporting system (1) according to claim 5, wherein the supply lines (3) are designed as two-wire lines, and/or the voltage source is designed as a d.c. voltage source.

7. The reporting system (1) according to claim 5, wherein the reporting devices (4) are designed as manual and/or automatic hazard signaling systems which connect a reporting resistor (Ra) when activated.

8. The reporting system (1) according to claim 7, wherein the reference resistor (R) has the same resistance or a resistance of the same magnitude as one of the reporting resistors (Ra).

9. The reporting system (1) according to claim 7, wherein the reference resistor (R) is designed as a reporting resistor (Ra) in one of the reporting devices (4).

10. The reporting system (1) according to claim 5, wherein the voltage source and the monitoring device are integrated in a reporting center (2).

11. A method for checking the operating capability of a reporting system (1), wherein the reporting system (1) includes a plurality of reporting devices (4) and/or signalling devices, supply lines (3), and a voltage source, the reporting devices (4) and signalling devices being connected to the voltage source via the supply lines (3), and wherein the reporting devices (4) and signalling devices are connected in parallel to one another and to the voltage source, preferably according to one of the preceding claims, wherein a reference resistor (R), as a terminating resistor and/or in parallel to a terminating resistor, is connected temporarily and/or in a pulsed manner, wherein the current flow (I) is measured in the region of the voltage source, and the operating capability of the reporting system (1) is determined by comparing the current flow value (I), with the reference resistor (R) connected, to a specified limit value (Is), wherein the monitoring device is configured such that connection of the reference resistor (R) simulates a reporting situation.

12. The method according to claim 11, wherein the temporal duration (delta t) of the connection of the reference resistor (R) is shorter than the signal duration of a triggered reporting device (4).

* * * * *